US005984781A

United States Patent [19]

Sunaga

[11] Patent Number: 5,984,781

[45] Date of Patent: Nov. 16, 1999

[54] GAMING MACHINE

[75] Inventor: Isao Sunaga, Tokyo, Japan

[73] Assignee: Aruze Corporation, Tokyo, Japan

[21] Appl. No.: 08/738,008

[22] Filed: Oct. 25, 1996

[30] Foreign Application Priority Data

Oct. 31, 1995 [JP] Japan ..... 7-283032

[51] Int. Cl.[6] ..... A63F 9/22

[52] U.S. Cl. ..... 463/20; 463/21; 463/16

[58] Field of Search ..... 463/16, 17, 20, 463/22, 43, 21; 273/143 R, 138.2

[56] References Cited

U.S. PATENT DOCUMENTS

| | | | |
|---|---|---|---|
| 4,448,419 | 5/1984 | Telnaes | 273/143 |
| 4,711,451 | 12/1987 | Pajak et al. | 463/22 |
| 4,858,932 | 8/1989 | Keane | 463/21 |
| 5,102,137 | 4/1992 | Ekiert | 273/143 R |
| 5,154,421 | 10/1992 | Hamano | 463/21 |
| 5,169,147 | 12/1992 | Hamano | 463/21 |
| 5,219,167 | 6/1993 | Hamano | 273/143 R |

*Primary Examiner*—Jessica J. Harrison
*Assistant Examiner*—James Schaaf
*Attorney, Agent, or Firm*—Rohm & Monsanto, PLC

[57] ABSTRACT

A gaming machine in which a game is controlled using virtual reels arranged to correspond to symbols of actual reels, increases the interest of a player in playing the game. A virtual symbol row arrangement is provided corresponding to a plurality of symbol rows to be displayed on a variable display, and is formed of the symbols that constitute each of the symbol rows. When a predetermined play condition is satisfied, a controller starts the operation of the variable display and samples random number values. In response to the sampled random number values, the controller determines stop symbols in the virtual symbol row arrangement for every symbol row. The controller controls the variable display to produce an image of the stop symbols when the variable display is stopped, and performs win determinations on a selected combination of the stop symbols. The virtual symbol row arrangement consists of at least two tables, with a plurality of virtual symbol rows disposed as one table. First and second ones of the tables differ from one another in position or number with respect to a particular symbol in one of the plurality of virtual symbol rows.

5 Claims, 6 Drawing Sheets

(VERTICAL REELS 1)

TABLE 1

| | 1ST REEL | 2ND REEL | 3RD REEL |
|---|---|---|---|
| 1. | BLUE7 | BLUE7 | BLUE7 |
| 2. | BLUE7 | BLUE7 | |
| 3. | BLUE7 | BLUE7 | |
| 4. | BLUE7 | BLUE7 | |
| 5. | BLUE7 | | |
| 6. | | | |
| 7. | 3BAR | 3BAR | 3BAR |
| 8. | 3BAR | | |
| 9. | | | |
| 10. | 1BAR | 1BAR | |
| 11. | 1BAR | 1BAR | 1BAR |
| 12. | | | |
| 13. | RED7 | | |
| 14. | RED7 | RED7 | RED7 |
| 15. | RED7 | RED7 | |
| 16. | RED7 | | |
| 17. | | | |
| 18. | | | |
| 19. | 3BAR | | 3BAR |
| 20. | 3BAR | 3BAR | |
| 21. | | | |
| 22. | 1BAR | 1BAR | |
| 23. | 1BAR | 1BAR | 1BAR |
| 24. | | | |
| 25. | 2BAR | | |
| 26. | 2BAR | 2BAR | |
| 27. | 2BAR | | 2BAR |
| 28. | | | |
| 29. | BLUE7 | | |
| 30. | BLUE7 | BLUE7 | |
| 31. | BLUE7 | BLUE7 | |
| 32. | BLUE7 | BLUE7 | BLUE7 |
| 33. | BLUE7 | | BLUE7 |
| 34. | | | |
| 35. | | | |
| 36. | 2BAR | 2BAR | |
| 37. | 2BAR | | 2BAR |
| 38. | | | |
| 39. | RED7 | RED7 | |
| 40. | RED7 | RED7 | |
| 41. | RED7 | | |
| 42. | RED7 | | RED7 |
| 43. | RED7 | | |
| 44. | | | |
| 45. | | | |
| 46. | 1BAR | 1BAR | |
| 47. | 1BAR | 1BAR | 1BAR |
| 48. | 1BAR | | |
| 49. | | | |
| 50. | | | |

TABLE 2

| | 1ST REEL | 2ND REEL | 3RD REEL |
|---|---|---|---|
| 1. | BLUE7 | BLUE7 | BLUE7 |
| 2. | | BLUE7 | BLUE7 |
| 3. | | BLUE7 | BLUE7 |
| 4. | | BLUE7 | BLUE7 |
| 5. | | | BLUE7 |
| 6. | | | |
| 7. | 3BAR | 3BAR | 3BAR |
| 8. | | | 3BAR |
| 9. | | | |
| 10. | | 1BAR | 1BAR |
| 11. | 1BAR | 1BAR | 1BAR |
| 12. | | | |
| 13. | | | RED7 |
| 14. | RED7 | RED7 | RED7 |
| 15. | | RED7 | RED7 |
| 16. | | | RED7 |
| 17. | | | |
| 18. | | | |
| 19. | 3BAR | | 3BAR |
| 20. | | 3BAR | 3BAR |
| 21. | | | |
| 22. | | 1BAR | 1BAR |
| 23. | 1BAR | 1BAR | 1BAR |
| 24. | | | |
| 25. | | | 2BAR |
| 26. | | 2BAR | 2BAR |
| 27. | 2BAR | | 2BAR |
| 28. | | | |
| 29. | | | BLUE7 |
| 30. | | BLUE7 | BLUE7 |
| 31. | | BLUE7 | BLUE7 |
| 32. | BLUE7 | BLUE7 | BLUE7 |
| 33. | BLUE7 | | BLUE7 |
| 34. | | | |
| 35. | | | |
| 36. | | 2BAR | 2BAR |
| 37. | 2BAR | | 2BAR |
| 38. | | | |
| 39. | | RED7 | RED7 |
| 40. | | RED7 | RED7 |
| 41. | | | RED7 |
| 42. | RED7 | | RED7 |
| 43. | | | RED7 |
| 44. | | | |
| 45. | | | |
| 46. | | 1BAR | 1BAR |
| 47. | 1BAR | 1BAR | 1BAR |
| 48. | | | 1BAR |
| 49. | | | |
| 50. | | | |

FIG. 3

| | 1ST REEL | 2ND REEL | 3RD REEL |
|---|---|---|---|
| 1. | BLUE7 | BLUE7 | BLUE7 |
| 2. | | | |
| 3. | 3BAR | 3BAR | 3BAR |
| 4. | | | |
| 5. | 1BAR | 1BAR | 1BAR |
| 6. | | | |
| 7. | RED7 | RED7 | RED7 |
| 8. | | | |
| 9. | 3BAR | 3BAR | 3BAR |
| 10. | | | |
| 11. | 1BAR | 1BAR | 1BAR |
| 12. | | | |
| 13. | 2BAR | 2BAR | 2BAR |
| 14. | | | |
| 15. | BLUE7 | BLUE7 | BLUE7 |
| 16. | | | |
| 17. | 2BAR | 2BAR | 2BAR |
| 18. | | | |
| 19. | RED7 | RED7 | RED7 |
| 20. | | | |
| 21. | 1BAR | 1BAR | 1BAR |
| 22. | | | |

FIG. 4

(NUMBER OF SYMBOLS)

| | 1ST REEL | 2ND REEL | 3RD REEL |
|---|---|---|---|
| BLUE7 | 2 | 2 | 2 |
| RED7 | 2 | 2 | 2 |
| 3BAR | 2 | 2 | 2 |
| 2BAR | 2 | 2 | 2 |
| 1BAR | 3 | 3 | 3 |
| BLANK(BLANKS) | 11 | 11 | 11 |

FIG. 5

(VERTICAL REELS 1)

TABLE 1

| | 1ST REEL | 2ND REEL | 3RD REEL |
|---|---|---|---|
| 1. | BLUE7 | BLUE7 | BLUE7 |
| 2. | BLUE7 | BLUE7 | |
| 3. | BLUE7 | BLUE7 | |
| 4. | BLUE7 | BLUE7 | |
| 5. | BLUE7 | | |
| 6. | | | |
| 7. | 3BAR | 3BAR | 3BAR |
| 8. | 3BAR | | |
| 9. | | | |
| 10. | 1BAR | 1BAR | |
| 11. | 1BAR | 1BAR | 1BAR |
| 12. | | | |
| 13. | RED7 | | |
| 14. | RED7 | RED7 | RED7 |
| 15. | RED7 | RED7 | |
| 16. | RED7 | | |
| 17. | | | |
| 18. | | | |
| 19. | 3BAR | | 3BAR |
| 20. | 3BAR | 3BAR | |
| 21. | | | |
| 22. | 1BAR | 1BAR | |
| 23. | 1BAR | 1BAR | 1BAR |
| 24. | | | |
| 25. | 2BAR | | |
| 26. | 2BAR | 2BAR | |
| 27. | 2BAR | | 2BAR |
| 28. | | | |
| 29. | BLUE7 | | |
| 30. | BLUE7 | BLUE7 | |
| 31. | BLUE7 | BLUE7 | |
| 32. | BLUE7 | BLUE7 | BLUE7 |
| 33. | BLUE7 | | BLUE7 |
| 34. | | | |
| 35. | | | |
| 36. | 2BAR | 2BAR | |
| 37. | 2BAR | | 2BAR |
| 38. | | | |
| 39. | RED7 | RED7 | |
| 40. | RED7 | RED7 | |
| 41. | RED7 | | |
| 42. | RED7 | | RED7 |
| 43. | RED7 | | |
| 44. | | | |
| 45. | | | |
| 46. | 1BAR | 1BAR | |
| 47. | 1BAR | 1BAR | 1BAR |
| 48. | 1BAR | | |
| 49. | | | |
| 50. | | | |

TABLE 2

| | 1ST REEL | 2ND REEL | 3RD REEL |
|---|---|---|---|
| 1. | BLUE7 | BLUE7 | BLUE7 |
| 2. | | BLUE7 | BLUE7 |
| 3. | | BLUE7 | BLUE7 |
| 4. | | BLUE7 | BLUE7 |
| 5. | | | BLUE7 |
| 6. | | | |
| 7. | 3BAR | 3BAR | 3BAR |
| 8. | | | 3BAR |
| 9. | | | |
| 10. | | 1BAR | 1BAR |
| 11. | 1BAR | 1BAR | 1BAR |
| 12. | | | |
| 13. | | | RED7 |
| 14. | RED7 | RED7 | RED7 |
| 15. | | RED7 | RED7 |
| 16. | | | RED7 |
| 17. | | | |
| 18. | | | |
| 19. | 3BAR | | 3BAR |
| 20. | | 3BAR | 3BAR |
| 21. | | | |
| 22. | | 1BAR | 1BAR |
| 23. | 1BAR | 1BAR | 1BAR |
| 24. | | | |
| 25. | | | 2BAR |
| 26. | | 2BAR | 2BAR |
| 27. | 2BAR | | 2BAR |
| 28. | | | |
| 29. | | | BLUE7 |
| 30. | | BLUE7 | BLUE7 |
| 31. | | BLUE7 | BLUE7 |
| 32. | BLUE7 | BLUE7 | BLUE7 |
| 33. | BLUE7 | | BLUE7 |
| 34. | | | |
| 35. | | | |
| 36. | | 2BAR | 2BAR |
| 37. | 2BAR | | 2BAR |
| 38. | | | |
| 39. | | RED7 | RED7 |
| 40. | | RED7 | RED7 |
| 41. | | | RED7 |
| 42. | RED7 | | RED7 |
| 43. | | | RED7 |
| 44. | | | |
| 45. | | | |
| 46. | | 1BAR | 1BAR |
| 47. | 1BAR | 1BAR | 1BAR |
| 48. | | | 1BAR |
| 49. | | | |
| 50. | | | |

FIG. 6

(VERTICAL REELS 2)

TABLE 1

| | 1ST REEL | 2ND REEL | 3RD REEL |
|---|---|---|---|
| 1. | BLUE7 | BLUE7 | BLUE7 |
| 2. | BLUE7 | BLUE7 | |
| 3. | BLUE7 | BLUE7 | |
| 4. | BLUE7 | BLUE7 | |
| 5. | BLUE7 | | |
| 6. | | | |
| 7. | 3BAR | 3BAR | 3BAR |
| 8. | 3BAR | | |
| 9. | | | |
| 10. | 1BAR | 1BAR | |
| 11. | 1BAR | 1BAR | 1BAR |
| 12. | | | |
| 13. | RED7 | | |
| 14. | RED7 | RED7 | RED7 |
| 15. | RED7 | RED7 | |
| 16. | RED7 | | |
| 17. | | | |
| 18. | | | |
| 19. | 3BAR | | 3BAR |
| 20. | 3BAR | 3BAR | |
| 21. | | | |
| 22. | 1BAR | 1BAR | |
| 23. | 1BAR | 1BAR | 1BAR |
| 24. | | | |
| 25. | 2BAR | | |
| 26. | 2BAR | 2BAR | |
| 27. | 2BAR | | 2BAR |
| 28. | | | |
| 29. | BLUE7 | | |
| 30. | BLUE7 | BLUE7 | |
| 31. | BLUE7 | BLUE7 | |
| 32. | BLUE7 | BLUE7 | BLUE7 |
| 33. | BLUE7 | | BLUE7 |
| 34. | | | |
| 35. | | | |
| 36. | 2BAR | 2BAR | |
| 37. | 2BAR | | 2BAR |
| 38. | | | |
| 39. | RED7 | RED7 | |
| 40. | RED7 | RED7 | |
| 41. | RED7 | | |
| 42. | RED7 | | RED7 |
| 43. | RED7 | | |
| 44. | | | |
| 45. | | | |
| 46. | 1BAR | 1BAR | |
| 47. | 1BAR | 1BAR | 1BAR |
| 48. | 1BAR | | |
| 49. | | | |
| 50. | | | |

TABLE 2

| | 1ST REEL | 2ND REEL | 3RD REEL |
|---|---|---|---|
| 1. | BLUE7 | BLUE7 | BLUE7 |
| 2. | BLUE7 | BLUE7 | |
| 3. | BLUE7 | BLUE7 | |
| 4. | BLUE7 | BLUE7 | |
| 5. | BLUE7 | | |
| 6. | | | |
| 7. | | | |
| 8. | | | |
| 9. | 3BAR | 3BAR | |
| 10. | 3BAR | | 3BAR |
| 11. | | 1BAR | |
| 12. | 1BAR | 1BAR | 1BAR |
| 13. | 1BAR | | |
| 14. | | RED7 | RED7 |
| 15. | RED7 | RED7 | |
| 16. | RED7 | | 3BAR |
| 17. | RED7 | 3BAR | |
| 18. | RED7 | | 1BAR |
| 19. | | 1BAR | |
| 20. | 3BAR | 1BAR | 2BAR |
| 21. | 3BAR | | |
| 22. | | 2BAR | |
| 23. | 1BAR | | |
| 24. | 1BAR | | |
| 25. | | | |
| 26. | 2BAR | | |
| 27. | 2BAR | | |
| 28. | 2BAR | | |
| 29. | | | |
| 30. | BLUE7 | BLUE7 | |
| 31. | BLUE7 | BLUE7 | |
| 32. | BLUE7 | BLUE7 | BLUE7 |
| 33. | BLUE7 | | BLUE7 |
| 34. | BLUE7 | | |
| 35. | | | |
| 36. | 2BAR | | |
| 37. | 2BAR | | |
| 38. | | 2BAR | |
| 39. | RED7 | | |
| 40. | RED7 | RED7 | 2BAR |
| 41. | RED7 | RED7 | |
| 42. | RED7 | | RED7 |
| 43. | RED7 | 1BAR | |
| 44. | | 1BAR | 1BAR |
| 45. | 1BAR | | |
| 46. | 1BAR | | |
| 47. | 1BAR | | |
| 48. | | | |
| 49. | | | |
| 50. | | | |

GAMING MACHINE

BACKGROUND OF THE INVENTION

1. Field of the Invention

This invention relates generally to gaming machines such as slot machines, ball-shooting game machines, poker game machines, and the like, and more particularly, to a gaming machine having a variable display for displaying a plurality of symbols that correspond to mechanically driven reels, or electrically-operated display means such as liquid crystal displays (LCDs), light emitting diodes (LEDs), cathode ray tubes (CRTs), or the like.

2. Description of the Prior Art

In a conventional slot machine, a rotating reel functions as a variable display. One or more such reels, illustratively three reels in a known arrangement, are provided with a plurality of symbols (e.g., twenty-two symbols) on peripheral surfaces thereof and are urged into rotation by a drive arrangement that may include a stepping motor. In use, the plural reels are caused to be rotated and a "win" is determined in response to a particular combination of symbols positioned on a predetermined winning line when the rotation of the reels ceases. Upon determining the occurrence of a win, coins or medals are paid out in a number or value that corresponds to the characteristic of the win.

In a gaming machine of the type that produces displays that vary with the multiplicity of combinations of the plurality of symbols as mentioned above, the variable displays are controlled by a control unit that consists of electronic circuitry, such as a microcomputer or the like, whereby the probability of a win is not greatly influenced by the skill of a player.

More particularly, in the case of the slot machine, when the player operates a lever or pushes a start button, the control unit drives the reels of the variable display into rotation, and samples a random number value. In response to the sampled random number value, the control unit determines the symbols (i.e.., stop symbols) that are displayed in display windows when the reels are stopped. Then, the control unit stops rotation of the reels in response to stop operations by the player or after a predetermined time period has passed. Afterward, the control unit performs win determination procedure.

In ball-shooting game machines, such as pachinko machines and the like, instead of operating the lever or pushing the start button as above, the control unit actuates a variable display and samples a random number value when a game ball has entered a winning zone called the "start hole." Then, depending upon the sampled value and the content of a winning table, the control unit determines whether the play is a win and also determines the stop symbols. The control unit controls the variable displays to stop after a predetermined time period has passed.

In a gaming machine comprising a variable display of video type (e.g., CRTs), graphical data corresponding to patterns of symbols is stored in a memory (symbol ROM) in accordance with a predetermined arrangement. The control unit reads the graphical data that is to be displayed at the variable display, from the symbol ROM.

When playing such gaming machines, the player can readily determine whether the play is a win or a loss, the number of play balls (prize) to be paid out for the player being determinable by viewing the plurality of symbol rows after they have been stopped. Therefore, the player watches the displays when each of the symbol rows is stopped, with significant interest.

In the above-mentioned gaming machines, the payout rate of the coins, determined in response to the odds of winning, is established with the probability that any particular combination of stop symbols will stand when the rotation of the plurality of reels that form the variable display ceases and the number of the coins to be paid out therefor. Thus, the player is greatly interested in the setting of the odds of winning, and the setting thereof is a significant consideration for the gambling establishment, as it ultimately affects the availability of the gaming machines and the resulting profitability of the business.

The odds of winning in gaming machines of the type that control the payout of coins in response to the random number sampling, as is the case in the gaming machines of the type wherein a stop symbol combination is determined with the use of a win determination table (stored in ROM) including winning symbol combinations having respectively associated probabilities of occurring, may be set by the gambling establishment as desired within a regulated range. Such is the case with slot machines employed in pachinko halls in Japan.

With respect to slot machines of the type generally used in the United States, the odds of winning, pursuant to regulations, cannot be modified freely after the slot machine has been installed in the gambling establishment. In addition, the probabilities associated with symbol combinations corresponding to a loss, as well as those corresponding to a win, must be calculated and the odds of occurrence must correspondingly be controlled. Thus, if the above method is employed, the control procedure becomes more complicated and operation time becomes longer. Therefore, in such slot machines, a known method of operation, described in U.S. Pat. No. 4,448,419, employs a table of probabilities correlated to the symbols of each reel, whereby the probability of occurrence of each symbol for each reel is determined in response to a random number value sampled by a random number sampling procedure. A table (stored in ROM) for each reel is thus referred to as a "virtual reel." The virtual reel is arranged to correspond to symbols similar to those on an actual reel sheet, but the number of symbols is different from an actual reel.

In gaming machines that employ the technique of the virtual reel, only a single combination of virtual reels is stored from which the stop symbols are determined in response to the random number sampling. Thus, after the gaming machines have been installed in the gambling establishment, as a player plays the game, the manner in which the stop symbols appear is decided, i.e., a pattern of standing of combinations of the stop symbols is getting decided, and the game becomes monotonous to make the player tired.

SUMMARY OF THE INVENTION

It is, therefore, an object of the present invention to provide a gaming machine wherein monotony of game is diminished and interest level of a player is increased, the gaming machine employing the virtual reel technique.

In accordance with the present invention, a gaming machine is provided with a variable display for displaying image information representative of a plurality of symbol rows. A virtual symbol row arrangement is provided corresponding to each of the symbol rows to be displayed by the variable display. The virtual symbol row arrangement is formed of symbols corresponding to each of the symbol rows. When a predetermined play condition is satisfied (e.g., when a player has performed a game start operation in the case of a slot machine, or a game ball has entered a start hole in the case of a ball-shooting game machine), a controller commences the operation of the variable display and samples random number values. In response to the sampled random values, the controller determines a stop symbol associated with the virtual symbol row arrangement for each symbol row. The controller controls the variable display whereby it displays the stop symbols when the variable display is stopped, and performs a win determination procedure corresponding to the combination of the stop symbols. The virtual symbol row arrangement consists of at least two tables, with a plurality of virtual symbol rows disposed corresponding to the plurality of symbol rows as one table. First and second ones of the tables differ from one another in the position or the number of a particular symbol in one of the plurality of virtual symbol rows.

Since the virtual symbol row arrangement consists of two or more tables, the table for determining a stop symbol combination is not always limited to one, and may be exchanged for the other table automatically in accordance with an appropriate predetermined condition for table exchange. In this regard, any state of the game that can be detected in the gaming machine may be employed, and desired one of such states may be selected, as the condition for table exchange, e.g., (1) when the number or time period of plays played by a player has reached a predetermined value; (2) the random number sampling is performed during the plays, and whether or not the table is to be exchanged is determined in response to the random number value; (3) when the stop symbol combination turns to a symbol combination predetermined as the table is exchanged when it appears; or other similar condition occurs.

In accordance with the invention, even while the player continues playing the game for a long time, the stop symbol combinations are not limited to particular ones, and therefore the game will remain interesting. Also, player interest is maintained by the manner in which the stop symbol combinations appear to be varied. For example, it is possible to give the player an expectation that the symbol combination corresponding to win may appear after the symbol combination corresponding to loss has appeared.

Although at least one table of the virtual symbol row arrangement is arranged to be different from the other table in the position or number of a particular symbol in one of the plurality of virtual symbol rows therein, there is no change in the number of symbols that form winning combinations. Thus, even if the tables are exchanged, there is no change in the player's probability of winning.

In one embodiment of the invention, the second table of the virtual symbol row arrangement is arranged by exchanging two rows among the plurality of virtual symbol rows that constitute the first table of the virtual symbol row arrangement. In the case of a slot machine, for example, three symbol rows on respective physical reels to be displayed at the variable display and three virtual symbol rows on respective virtual reels in a system memory are provided. By exchanging a first virtual symbol row and a third virtual symbol row in the first table of the virtual symbol row arrangement, the second table therein is arranged. Thus, there is no change in the number of the symbols by exchanging of the tables, and two or more tables can readily be made without changing the odds of winning.

In accordance with another embodiment of the invention, the second table of the virtual symbol row arrangement is arranged by modifying the distribution (numbers or positions) of symbols positioned before and after a particular winning symbol that forms winning combinations, in the plurality of virtual symbol rows that constitute the first table of the virtual symbol row arrangement. In the other table, the number of all the symbols that form the winning combinations may be fixed. Also, a table may be arranged wherein the manner in which the stop symbol combinations appear is varied, without changing the odds of winning.

BRIEF DESCRIPTION OF THE DRAWINGS

The foregoing and other objects, features, and advantages of the invention will become more apparent from the following detailed description taken in conjunction with the accompanying drawings, in which:

FIG. 3 is a tabular diagram that schematically illustrates symbol rows disposed on three reels of the embodiment;

FIG. 4 is a tabular diagram that schematically illustrates kinds and numbers of symbols in the symbol rows of FIG. 3;

FIG. 5 is a tabular diagram that schematically illustrates two tables that constitute a virtual symbol row arrangement provided corresponding to the three reels of FIG. 3;

FIG. 6 is a tabular diagram that schematically illustrates the other tables that are different from FIG. 5;

DETAILED DESCRIPTION

Figure 1:
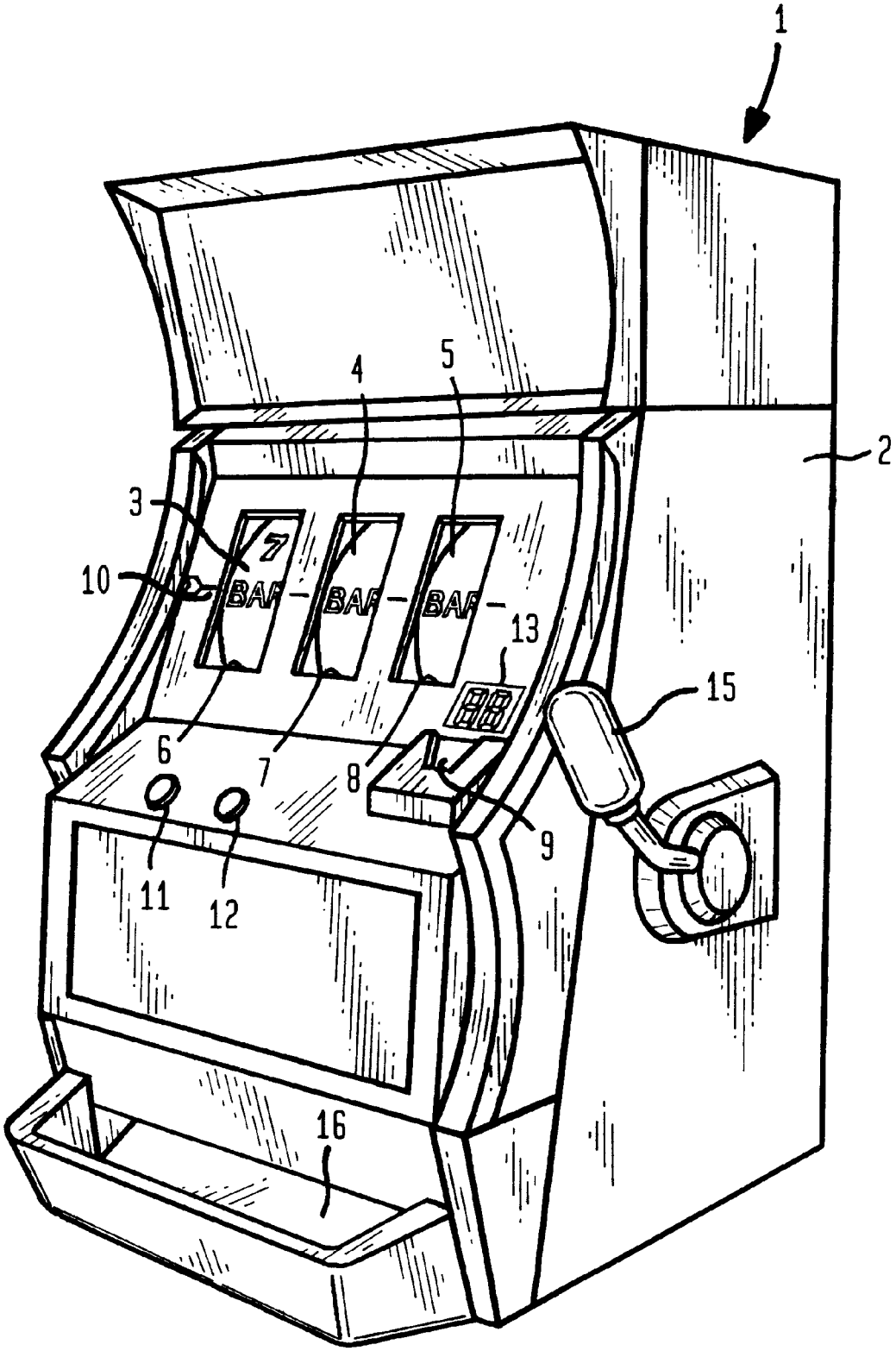
FIG. 1 is a perspective representation of a specific illustrative embodiment of the invention in the form of a slot machine.

FIG. 1 is a perspective representation of a specific illustrative embodiment of the invention in the form of a slot machine 1. Within a body 2 of slot machine 1, three rotatable reels 3, 4, and 5 are provided to form a variable display, with symbol rows that consist of a plurality of predetermined kinds of symbols depicted on each peripheral surface. Each symbol row of reels 3, 4, and 5 can be observed in this embodiment, through respective display windows 6, 7 and 8 on the front face of body 2. Below display windows 6, 7, and 8 on the right-hand side, there is provided an entry slot 9 for the player (not shown) to deposit game media such as coins, medals, or substitute currency referred as "token." Hereinafter, the game media will be referred to as "coins."

In slot machine 1, when the player deposits one to three coins via entry slot 9, a winning line 10 is turned to be effective at the moment when the first coin has been deposited therein. The effective winning line 10 is displayed for the player by illuminating an indicator lamp (not shown) that is arranged in the vicinity of the winning line at the front of body 2. Also at the front of body 2, there are provided a coin payout button 11 and a coin bet button 12 for setting the number (e.g., one to three) of coins permitted for the player to deposit in one play. When the player presses coin payout button 11, the coins of the number indicated on a credit number indicator 13 are paid out.

After the player has deposited the coins, the player operates start lever 15 and first reel 3, second reel 4, and third reel 5 are rotated, whereby a symbol row of each reel is moved downward from above. When a predetermined time period has passed since each of reels 3, 4, and 5 were rotated at uniform velocity, each of the reels is stopped in the order of first reel 3, second reel 4, and third reel 5. Then, when the combination of the symbols stopped on winning line 10 represents a win, the frequency of indications of coins as a prize on credit number indicator 13 rises in response to the kind of win and the number of coins previously deposited.

Figure 2:
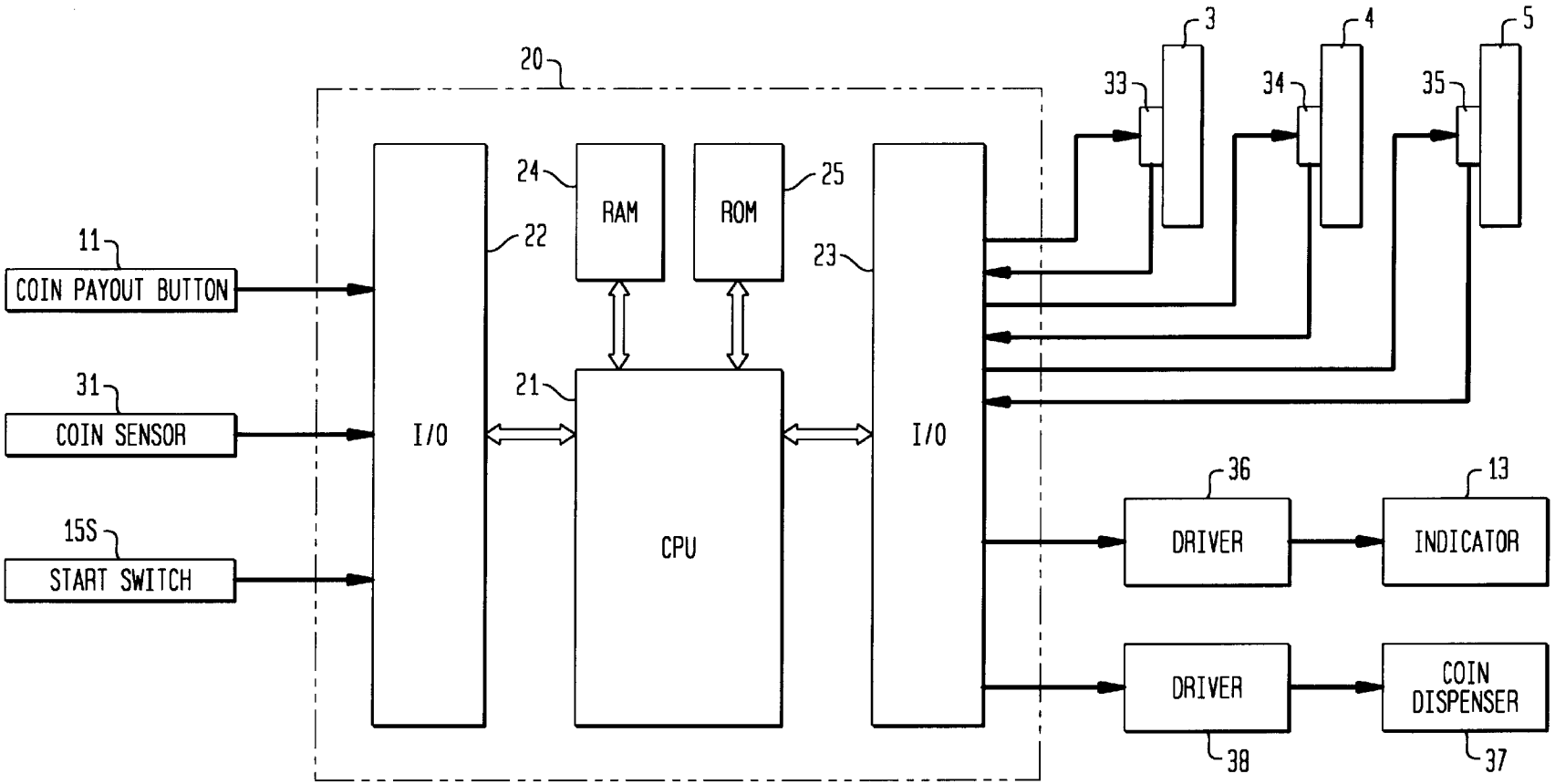
FIG. 2 is a function block diagram that illustrates the arrangement of an electric circuit aspect of the embodiment of the invention.

FIG. 2 is a function block diagram that illustrates the arrangement of an electric circuit portion of the specific illustrative embodiment of the invention. The circuit portion operates under the control of a microcomputer 20 that includes a CPU 21 that functions as a controller, I/O ports 22 and 23 functioning as interfaces, a RAM 24, and a ROM 25 that forms a memory portion. In addition, a pulse generator (not shown) is connected to CPU 21 for providing reference clock pulses (e.g., 4 MHz) in response to which the CPU operates. Also, a frequency divider (not shown), is connected to the CPU, for inputting interruption pulses (e.g., at a frequency of 500 Hz) for enabling an interruption by a predetermined program.

A program for performing random number sampling as described hereinafter is stored in CPU 21. In other embodiments, a random number generator (not shown) for generating random numbers to be sampled and a random number sampling circuit (also not shown) may be connected to CPI 21.

ROM 25 has a memory portion divided into several sub-portions (not shown) for respectively storing a symbol table, a winning probability table, and a sequence program. The symbol table contains data corresponding to position codes (e.g., of "1" to "22") for showing positions of rotation from reference position of each reel as described hereinafter, and data corresponding to symbol codes for showing the kinds of the symbols arranged on each reel. Two or more tables that form a virtual symbol row arrangement, as will be described in detail hereinafter, are included therein. The winning probability table contains data showing the symbol combinations corresponding to a "big win" and to other wins. In the sequence program, procedures of a game program are written.

CPU 21 determines the symbols of the virtual reels to which the values of the random numbers sampled, as described hereinafter, correspond. In response to the result, CPU 21 determines the symbols to be stopped on the winning line when the reels are stopped. The determination of the stop symbols is performed before each reel starts to rotate.

Signals from the above-mentioned coin payout button (switch) 11, a coin sensor 31 for delivering a game start signal when the coins deposited via entry slot 9 are detected or when coin bet button 12 is operated, and start switch 15S that is actuated in response to operation of a lever by a player (not shown) for delivering a start signal for starting each reel from CPU 21 when the player operates start lever 15, are delivered via I/O port 22 to microcomputer 20. Further, signals from symbol position detectors (not specifically shown) which are incorporated within respective reel drivers 33, 34, and 35 including pulse motors (or stepping motors) for driving reels 3, 4, and 5, respectively, and motor drive circuits, are inputted via I/O port 23 to microcomputer 20. Connected to I/O port 23 are the above-mentioned credit number indicator 13 via indicator drive circuits 36 and coin dispenser 37 via dispenser drive circuits 38.

The pulse motors of reel drivers 33, 34, and 35 are controlled in their rotation in response to the numbers of drive pulses supplied from microcomputer 20, and their rotation velocity by pulse intervals of the drive pulses. These numbers of the drive pulses are counted in the counters set in a program corresponding to each reel, and the counter values are stored in RAM 24.

The detectors for detecting positions of the symbols on the reels rotating as described above consist of photosensors (not shown) that are provided for detecting movement of shading elements disposed at predetermined positions on each peripheral surface of reels 3, 4, and 5. These photosensors deliver the pulses for resetting the above-mentioned counter values stored in RAM 24. Thus, when a reset pulse is delivered from a corresponding photosensor, the counter value of the counter is reset to "0." Therefore, the counter value of each counter corresponds to rotation angle of each reel within the range of one rotation. Since the ordered sequence of the arrangement of the symbols at a certain pitch on each reel is known, if the rotation angle of each of reels 3, 4, and 5 from the reference position is established by the counter value of each counter, each of the symbols positioned on the winning line at the time can be determined.

The value in each counter corresponds to code numbers of 1 to 22 (FIG. 3) indicative of the positions of the symbols of each reel as described hereinafter. This value is updated to be recorded in RAM 24 for each counter. CPU 21 can acquire the positions of the symbols rotating on each of reels 3, 4, and 5 in the range of one rotation, by interrogating the counter values stored in RAM 24 and the symbol table stored in ROM 25.

FIG. 3 is a tabular diagram that schematically illustrates a specific illustrative embodiment of the symbol rows disposed on the surfaces of each of the first, second, and third reels. FIG. 4 is a tabular diagram that illustrates the kinds and numbers of the symbols in the symbol rows of FIG. 3. Each of the symbol rows consists of 22 symbols (positions). Each of the symbol positions is designated with one of the code numbers of "1" to "22," and is stored as symbol data in a table in ROM 25. Each of the reels is driven into rotation in the direction where the code numbers of the symbols passing the winning line are in the ordered sequence of "1" to "22."

In the embodiment of FIG. 3, there are six kinds of symbols as "BLUE7" represented as a blue "7", "RED7" represented as a red "7", "3BAR", "2BAR", "1BAR", and "BLANK" represented as a blank to be representative of a "loss." As shown in FIG. 4, each of the reels is provided with two "BLUE7s," two "RED7s," two "3BARs," two "2BARs," three "1BARs," and eleven "BLANKs."

Referring to the gaming machine of the embodiment, the numbers of the coins to be paid out when the variable display formed of reels 3, 4, and 5 has been stopped and the symbol combination thereof corresponds to a win, are prescribed as in the following AWARD TABLE:

AWARD TABLE

| | COIN BET | | |
|---|---|---|---|
| SYMBOL COMBINATIONS | 1 COIN | 2 COINS | 3 COINS |
| 1BLUE7-BLUE7-BLUE7 | 800 | 1600 | 2400 |
| ② RED7 -RED7 -RED7 | 200 | 400 | 600 |
| ③ ANY7-ANY7-ANY7† | 100 | 200 | 300 |
| ④ 3BAR 3BAR 3BAR | 40 | 80 | 120 |
| ⑤ 2BAR 2BAR 2BAR | 20 | 40 | 60 |
| ⑥ 1BAR 1BAR 1BAR | 10 | 20 | 30 |
| ⑦ ANYB-ANYB-ANYB†† | 5 | 10 | 15 |

†"ANY7" may be either "BLUE7" or "RED7."However, ③ is a combination that excludes combinations ① or ②.

AWARD TABLE-continued

| SYMBOL COMBINATIONS | COIN BET 1 COIN | 2 COINS | 3 COINS |
|---|---|---|---|

††"ANYB" may be any of "3BAR," "2BAR", or "1BAR." However, ⑦ is a combination that excludes combinations ④, ⑤, or ⑥.

In the AWARD TABLE, since the odds of winning with the symbol combinations ① to ③ are higher than others, the player will eagerly concentrate on whether or not the stop symbols becomes one of those combinations.

FIGS. 5 and 6 are tabular diagrams that illustrate schematically tables that form virtual symbol row (virtual reel) arrangements that corresponds to a plurality of actual symbol rows as mentioned above. The virtual symbol arrangements of these figures are each formed of two tables having symbols (positions) of "1" to "50" (50 pieces), respectively, and are stored in ROM 25 of microcomputer 20.

In the virtual symbol row arrangement of FIG. 5, Table 1 is arranged as follows:

In a first virtual reel:

"BLUE7s" are positioned at "1"~"5", and "29~"33" (10 pieces);

"RED7s" are positioned at "13~16", and "39"~"43" (9 pieces);

"3BARs" are positioned at "7"~"8", and "19"~"20" (4 pieces);

"2BARs" are positioned at "25"~"27", and "36"~"37" (5 pieces);

"1BARs" are positioned at "10"~"11", and "22"~"23", and "46"~"48" (7 pieces); and "BLANKs" are positioned at symbol positions exclusive of those of the above (15 pieces).

In a second virtual reel:

"BLUE7s" are positioned at "1"~"4", and "30"~"32" 32" (7 pieces);

"RED7s" are positioned at "14"~"15", and "39"~"40" (4 pieces);

"3BARs" are positioned at "7" and "20" (2 pieces); "2BARs" are positioned at "26" and "36" (2 pieces); "1BARs" are positioned at "10"~"11", and "22"~"23", and "46"~"47" (6 pieces); and "BLANKs" are positioned at symbol positions except those of the above (29 pieces).

In a third virtual reel:

"BLUE7s" are positioned at "1", and "32"~"33" (3 pieces);

"RED7s" are positioned at "14", and "42" (2 pieces);

"3BARs" are positioned at "7", and "19" (2 pieces);

"2BARs" are positioned at "27", and "37" (2 pieces);

"1BARs" are positioned at "11", "23", and "47" (3 pieces); and

"BLANKs" are positioned at symbol positions except those of the above (38 pieces).

As mentioned above, in the first virtual reel, the "BLUE7" of code number 1 of FIG. 3 corresponds to the codes "1" to "5". The "BLANK" represented with a blank of the code number 2 of FIG. 3 corresponds to code "6". The "3BAR" of code number 3 of FIG. 3 corresponds to the codes "7" and "8". Similarly, each symbol of each code number in the first reel of FIG. 3 corresponds to one or more code numbers in the first virtual reel of FIG. 5. In the second and third virtual reels, each symbol of each code number in the second and third reels of FIG. 3 corresponds to one or more code numbers, respectively.

In cases where the game being played is controlled in accordance with Table 1, for example, if "BLUE7" has been stopped at each of the first and second reels respectively on the winning line, "BLUE7" is stopped at one symbol position above or below the winning line at the third reel (i.e., a symbol combination of "BLUE7-BLUE7-BLANK" is caused to stand on the winning line) when "BLUE7" is stopped at one position above the winning line, i.e., "BLANK" next to "BLUE7" is stopped on the winning line at the third (virtual) reel of FIG. 5 (codes of "2" to "6", and "34" to "36"), and also when "BLUE7" is stopped at one position below the winning line, i.e., "BLANK" just preceding "BLUE7" is stopped on the winning line, at the third (virtual) reel of FIG. 5 (codes of "28" to "31", and "48" to "50").

In cases where the game being played is controlled in accordance with Table 2, since this table is arranged by exchanging the first and third virtual reels of Table 1, the first reel and the third reel are reversed, and "BLUE7" is not often stopped on the winning line at the first reel. The symbol combination of "BLUE7-BLUE7-BLANK", which does not correspond to "win" but may cause the player regret, does not often appear. Instead, a symbol combination of "BLANK-BLUE7-BLUE7", which may not cause the player as much regret often appear. Accordingly, as to the winning combination with "BLUE7," the controlling of the game under Table 1 may cause the player more regret than with the use of Table 2.

In Table 2, although the above regretful symbol combination for the player does not often appear, the probability of win rises when "BLUE7s" have stood at the first and second reels. After "BLUE7s" have stopped at the first and second reels, the player expects a win, until the third reel is stopped. On the other hand, in Table 1, the symbol combination that is regretful for the player often appears. When "BLUE7s" have stopped at the first and second reels on the winning line, the player does not much expect there will be a win when the third reel stops.

In detail, the frequency that "ANY7" (either "BLUE7" or "RED7") is stood at the first and second reels is as follows:

In Table 1 of FIG. 5:

$$(\text{number of all "ANY7s" on the first reel/number of all symbols on the first reel}) \times (\text{number of all "ANY7s" on the second reel/number of all symbols on the second reel}) = (19/50) \times (11/50) \approx 1/11.96$$

That is, "ANY7" stands at the winning line of the first and second reels once in about twelve plays.

Also, since the number of all "ANY7s" on the third reel is 5, the frequency that "ANY7" is stood on the third reel is 5/50=1/10, i.e., once in 10 plays. Thus, at the virtual reels of Table 1, the frequency that symbol combinations of ① to ③ of the above-mentioned AWARD TABLE appear is as follows:

$$(19/50)\times(11/50)\times(5/50)\approx 1/119.6$$

That is, once in about 120 plays.

In Table 2:

$$(\text{number of all "ANY7s" on the first reel/number of all symbols on the first reel}) \times (\text{number of all "ANY7s" on the second reel/number of all symbols on the second reel}) = (5/50) \times (11/50) \approx 1/45.45$$

That is, "ANY7" stands at the winning line of the first and second reels once in about 46 plays.

Also, since the number of all "ANY7s" on the third reel is 19, the frequency that "ANY7" is stood on the third reel is 19/50≈1/2.63, i.e., once in about 3 plays. Thus, at the virtual reels of Table 2, the frequency that symbol combinations of ① to ③ of the above-mentioned AWARD TABLE appear is as follows:

$$(5/50)\times(11/50)\times(19/50)\approx 1/119.6$$

That is, once in about 120 plays.

As described above, in the virtual symbol row arrangement of FIG. 5, though Tables 1 and 2 are different in the frequency that "ANY7" will stand on the winning line of the first and second reels and the frequency (probability) that "ANY7" will stand on the winning line of the third reel, the frequency that the symbol combinations of ① to ③ of the AWARD TABLE appear is finally identical with one another. This applies to all of the seven kinds of symbol combinations shown in the AWARD TABLE, no matter which table is employed, i.e., if the employed table is exchanged, the odds of winning (i.e., the number of the coins to be paid out) is not changed. However, the interest in the game for the player may be considerably varied.

In addition, in the embodiment shown in FIG. 5, although Table 2 is arranged by exchanging the first and third virtual reels of Table 1, the first and second virtual reels may be exchanged, or the second and third virtual reels may be exchanged instead.

In the virtual symbol row arrangement of FIG. 6, Table 1 is identical to that of FIG. 5, and Table 2 is arranged by modifying the distribution of "BLANKs" positioned before and after a particular symbol in Table 1.

More specifically, the number of "BLANKs" (losing symbols) in each virtual reel of Table 2 is not different from that of each virtual reel of Table 1, "BLANK" next to "BLUE7" (winning symbol) is weighed. That is, the number of "BLANKs" following "BLUE7" is increased. At the first virtual reel, it is increased from one row "6" of Table 1 to three rows "6" to "8" of Table 2. Furthermore, the arrangement of "BLANKs" as well as their number is modified. For example, at the third (virtual) reel of Table 2, "BLANKs" positioned between "BLUE7" and "3BAR:" are increased to the codes "2" to "9", and "BLANKs" positioned between "2BAR" and "BLUE7" are also increased to the codes "21" to "31" and "34" to "39". Thus, the symbol combination often appears that does not correspond to a win, but may give the player a feeling of regret, wherein, "BLUE7" of the third reel is positioned at one symbol position above or below the winning line. In addition, the symbol positioned before or after the particular symbol is not limited as are such losing symbol as "BLANK", and any symbol that differs from the particular symbol may be employed instead.

The virtual symbol row (virtual reel) arrangement according to the invention is not limited as is the above-mentioned embodiment, and it may be formed so as to satisfy a condition that the rate for paying out of the coins is equal at all the plurality of tables.

Furthermore, when the microcomputer detects that a condition for exchanging the tables in the virtual symbol row arrangement has been satisfied, the tables are exchanged. Such condition for table exchange will be explained hereinafter.

Figure 7:
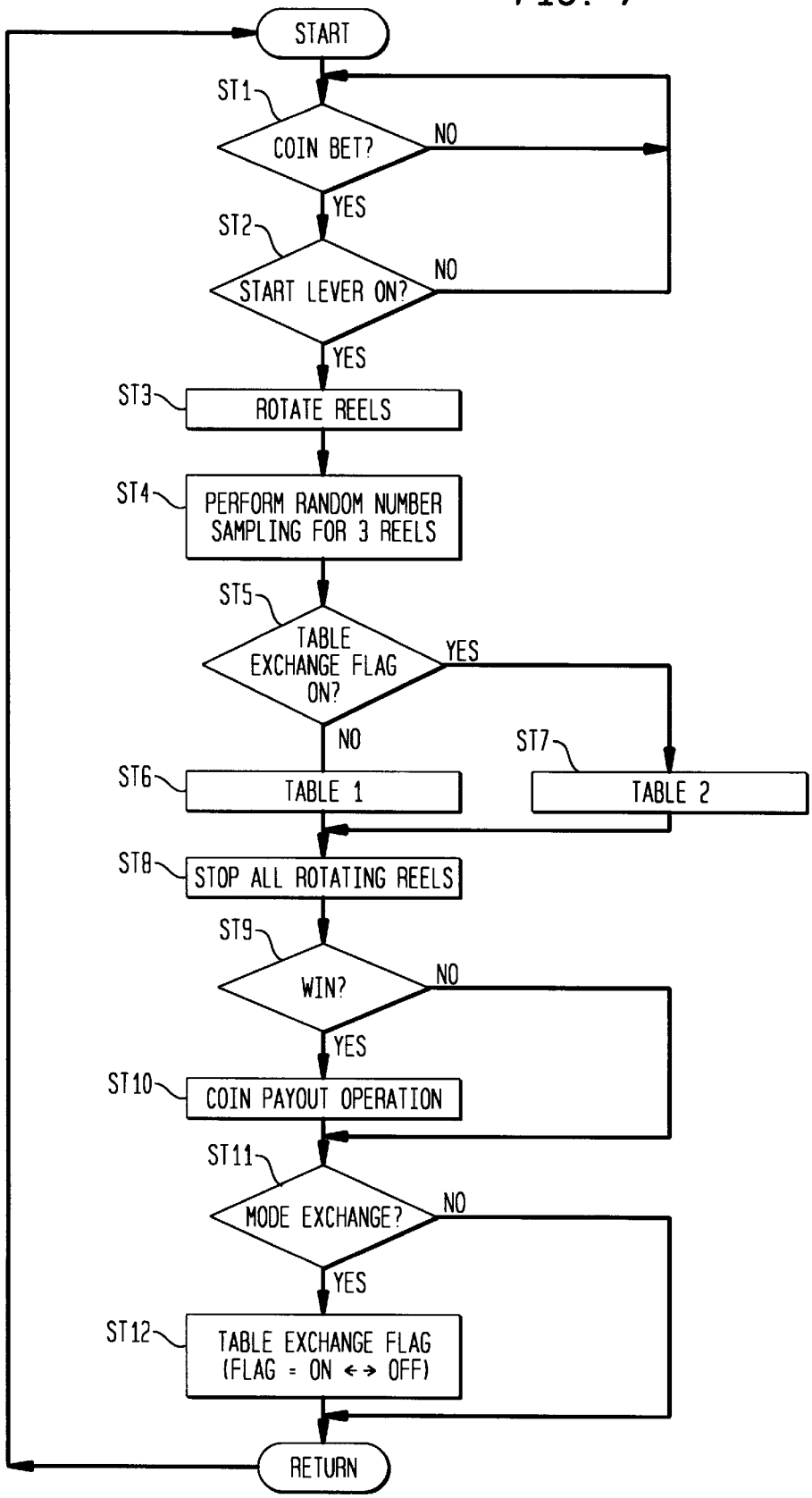
FIG. 7 is a flow chart that illustrates the operations by a controller of the embodiment.

Next, there will be described game operations controlled by the microcomputer 20 of the gaming machine of the invention. FIG. 7 is a flow chart that illustrates the operations by the controller of the embodiment.

Referring to FIG. 7, CPU 21 first determines whether or not a coin bet is performed (at step ST1). The answer to this determination is "YES" when the coin has been deposited into entry slot 9 and coin sensor 31 has delivered a detection signal to CPU 21. In that case, it is then determined whether start switch 15S has delivered a signal (the start signal) to CPU 21 by operating the start lever 15 (at step ST2). If the answer to the determination is "YES", CPU 21 supplies drive signals to the reel drivers 33, 34, and 35 via I/O port 23 to drive all reels 3, 4, and 5 into rotation (at step ST3).

On the peripheral surface of each of the reels 3, 4, and 5, the symbols, e.g., twenty-two symbols are arranged to construct each symbol row, as shown in FIG. 3. Each of reels 3, 4, and 5 is driven into rotation in the direction where each symbol row appears upward from below.

As shown in FIG. 7, CPU 21 drives reels 3, 4, and 5 into rotation (at step ST3), and performs random number sampling for every reel (at step ST4) for win determination that will be described hereinafter. The random number sampling is performed in a program by known means.

Next, in response to sampled random number values, in order to judge which table of the virtual symbol row arrangement FIGS. 5 or 6) is employed to determine the stop symbol at each reel, ON/OFF of a virtual reel flag (or table exchange flag) is judged (in step ST5). If the virtual reel flag is off, Table 1 is employed (at step ST6), and if the flag is on, Table 2 is employed (at step ST7). In each case, referring to the table employed, the stop symbol at each reel is determined in response to each of three random number values sampled for every reel.

Each reel is controlled so as to display each stop symbol of above (at step ST8). Then, it is determined whether the symbol combination that is displayed after the reels have been stopped is or is not a win, i.e., a win determination is performed (at step ST9). In the win determination, after the reels have been stopped, it is determined to which win the symbol combination corresponds, by reference to a winning combination table stored in ROM 25. If the win determination results in a win, a coin payout operation is performed (at step ST10). In the coin payout operation, the number of the coins corresponding to the kind of the win is added on the credit, or a predetermined number of coins are paid out. After the coin payout operation has been performed (if the win determination results in "loss", the coin payout operation is not performed), and the operations proceed to the following step (ST11).

In step ST11, it is determined whether or not the tables of the virtual symbol row arrangement are to exchange, i.e., whether or not mode exchange is performed. As to a condition for exchange, either of the following can be employed.

Number of plays: whether or not the predetermined number of plays have been played.

Random numbers: whether or not a condition that had been set in response to the random number has been satisfied.

Time period: whether or not the predetermined time period has passed.

Trigger: whether or not a table exchange symbol has been appeared.

When a predetermined one of the above conditions for exchange has been satisfied, if two tables have been employed as mentioned above, the virtual reel flag is switched from "on" to "off,"or from "off" to "on" (at step ST12). If three or more tables have been employed, a predetermined table number of 1, 2, 3, . . . is exchanged in a counter or the like within CPU 21. After the tables have been exchanged, or if the above conditions for exchange are not satisfied, the tables are not exchanged and then the game is over.

This invention may be applied to gaming machines that perform movement and stop of the symbol rows by electrical display means such as LCDs, LEDs, and CRTs, in addition to mechanical variable displays of driven reels, as in the embodiments described above. The number of the symbols that constitute one symbol row and the number of the symbol rows may not be limited as shown, but may be provided as desired.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A gaming machine comprising:

a variable display for displaying image information representative of a plurality of symbol rows;

a virtual symbol row arrangement responsive to a plurality of the symbol rows to be displayed on said variable display, said virtual symbol row arrangement being formed of symbols, each such symbol having a predetermined relationship to a respective one of the plurality of symbol rows; and a controller for operating the variable display when a predetermined play condition is satisfied, sampling random number values, determining stop symbols at a winning line associated with said virtual symbol row arrangement for each of the plurality of symbol rows in response to the sampled random number values, controlling the variable display to display the stop symbols when the variable display is stopped, and performing a win determination corresponding to a combination of the stop symbols;

wherein the virtual symbol row arrangement is in the form of at least first and second tables, each such table including a plurality of virtual symbol rows, each such symbol having a predetermined relationship to a respectively associated one of the plurality of symbol rows to be displayed on the variable display and being different in position and/or number of a particular symbol in at least one of the plurality of virtual symbol rows, and wherein the controller selects one of the first and second tables in the virtual symbol row arrangement under a predetermined condition when the controller executes the determination of the stop symbol.

2. The gaming machine of claim 1, wherein the second table of the virtual symbol row arrangement is arranged by exchanging two rows among the plurality of virtual symbol rows that constitute the first table of the virtual symbol row arrangement when a predetermined condition has been satisfied.

3. The gaming machine of claim 2, wherein the plurality of symbol rows comprises three symbol rows to be displayed on the variable display and the second table of the virtual symbol row arrangement is arranged in response to an exchange of a first virtual symbol row and a third virtual symbol row in the first table of the virtual symbol row arrangement.

4. The gaming machine of claim 1, wherein the second table of the virtual symbol row arrangement is arranged by modifying the distribution of symbols positioned before and after a particular winning symbol that forms winning combinations, in the virtual symbol rows that constitute the first table of the virtual symbol row arrangement.

5. The gaming machine of claim 1, wherein the first and second tables of the virtual symbol arrangement each include a respective plurality of virtual symbol rows, the number of symbols that form winning combinations remaining unchanged.

* * * * *